United States Patent [19]

Schwarze

[11] 4,137,743

[45] Feb. 6, 1979

[54] PROCESS AND APPARATUS FOR BENDING TWO TUBES WITH ONE EXTENDING THROUGH THE OTHER

[76] Inventor: Rigobert Schwarze, Olpener Str. 460-474, Cologne 91, Fed. Rep. of Germany, 5000

[21] Appl. No.: 823,831

[22] Filed: Aug. 11, 1977

[30] Foreign Application Priority Data

Aug. 20, 1976 [DE] Fed. Rep. of Germany ..... 2637454

[51] Int. Cl.[2] ..... B21D 9/05

[52] U.S. Cl. ..... 72/150; 72/369

[58] Field of Search ..... 29/423; 72/149, 150, 72/154, 155, 156, 159, 369, 370

[56] References Cited

U.S. PATENT DOCUMENTS

| | | | |
|---|---|---|---|
| 3,343,250 | 9/1967 | Berto et al. | 29/423 |
| 3,546,917 | 12/1970 | Paine | 72/369 |
| 4,009,601 | 3/1977 | Shimizu | 72/369 |
| 4,063,441 | 12/1977 | Eaton | 72/154 X |

*Primary Examiner*—E. M. Combs

*Attorney, Agent, or Firm*—Michael J. Striker

[57] ABSTRACT

To fabricate a bent assembly of two metal tubes with one extending through and radially spaced within the other, the bending is done by inserting the smaller through the larger tube producing a tubular work assembly, clamping a leading work portion onto a bending forming die with the inner tube eccentric in the region to be bent against the die-adjacent inner wall portion of the outer tube, bending the region trailing the clamped portion by wrapping onto the bending die, while at (and immediately preceding) the point of feed onto the die the tubes are supported against collapse by a cylindrical mandrel in the smaller tube and a mandrel of crescent cross-section interposed between the large and small tube, in the plane of bending providing reaction support by a slideshoe bearing against the outer tube diametrically remote from the die; the mandrels being axially shiftably supported.

16 Claims, 9 Drawing Figures

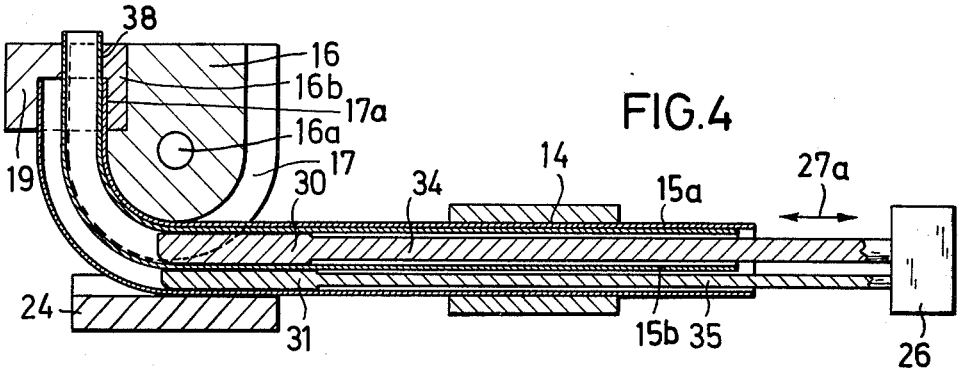
FIG.4
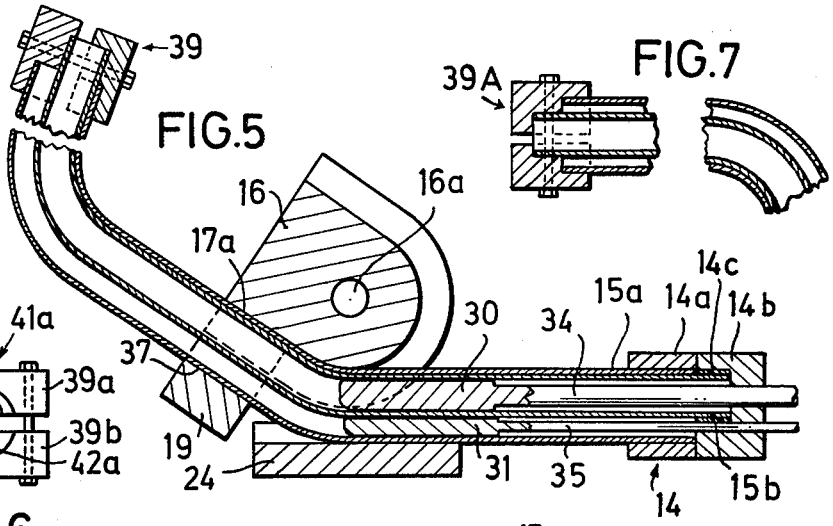
FIG.5
FIG.7
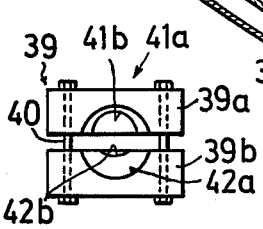
FIG.6
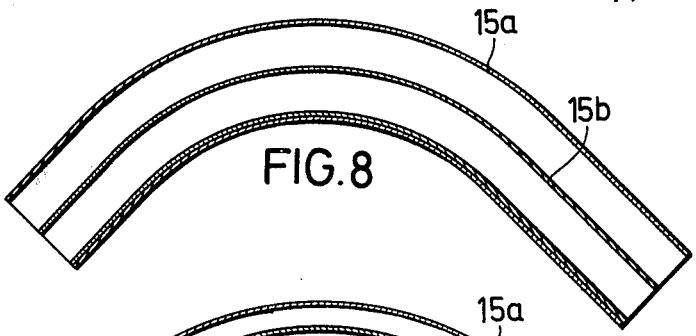
FIG.8
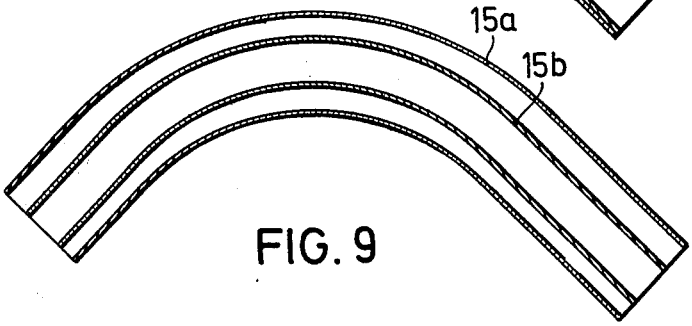
FIG. 9

PROCESS AND APPARATUS FOR BENDING TWO TUBES WITH ONE EXTENDING THROUGH THE OTHER

The present invention is concerned with a method for fabricating a final assembly of two bent tubes disposed one within the other with a radial spacing, by insertion of one tube into and supporting it eccentrically in the other, while simultaneously bending both tubes, and also is concerned with an apparatus for carrying out of the method.

Shaped so-called double-wall tubes, that is, bent radially spaced double-tube assemblies derived from two tubes rather greatly differing in diameter and with one inserted into the other, have hitherto been fabricated on a commercial basis generally by one of two methods.

In one method this was done by bending the two tubes separately; slitting and opening the larger, i.e., outer tube at a longitudinal plane; placing and fixing the smaller inner tube in the slit-open larger tube; and then finally welding the outer tube together again at its separation line. This method has the disadvantages that it is very inconvenient and not suitable for production line fabrication.

By the other said prior method, there is provided a straight "work assembly" (in a type of arrangement hereinafter also referred to as a "tubular work assembly") of one small diameter straight tube inserted in a straight larger tube; the tubes are located coaxially and to prevent bending tube collapse, the inner tube and also the space between the inner tube and the outer tube at the region to be bent are filled with molten plastic resin then allowed to solidify, or are filled with sand or with fine metal shot; the bend of both tubes is simultaneously made; and after the bending, and perhaps at least partial permanent securement of the two tubes to each other, the spacing filler is simply emptied out, the thermoplastic synthetic resin of course by melting to fluid condition. This use of spacing fillers in the bending of an insertion tubular work assembly disadvantageously is extremely costly and time consuming, so that this method of operation again is not suitable for assembly line and high rate production operations. Moreover, a total removal of the filling material, especially of the resin, is quite difficult and practically not possible.

The general object of the present invention is to carry out economically the simultaneous bending shaping of two tubes disposed with one inserted through the other as a tubular work unit or assembly without application of a filling material, and in a manner enabling machine performance of bending operations in rapid succession.

For the attainment of this object, the method produces a tubular work assembly of the two tubes with the smaller introduced into or through the larger; in advance of the region to be shaped the tubular work is clamped on a bending forming die for the bending operation, to be wrappingly effected by relative rotation motion between the die and work; the outer tube is reaction-shoe-supported at a location trailing the die and on the side away from the die; and the tubes are supported against bending collapse, by mandrel-like support means at the region of sliding reaction shoe support and located within the smaller tube and in the space between the inner and outer tube; and the reaction support being communicated from the reaction shoe to the other support means.

For carrying out the method, on a tubing bending machine conventionally including a tubular work gripping and advancing collet carriage, a swingable bending table having a bending forming die, a cooperating tube-clamping jaw shiftable towards and away from the die, then at a region where tubing wrappingly encounters the die, a sliding reaction support shoe for the tubular work, the present invention characteristically requires, located in the bending plane between the die and reaction shoe, a first internal support means or mandrel of crescent-shaped cross-section for disposition in the residual inter-tube space remote from the die between an outer tube and an inner tube eccentrically disposed in the said plane against the outer tube, and second extending parallel thereto, a cylindrical mandrel or internal support means for disposition in the inner tube.

Thus the sliding reaction support shoe can transmit its tube-supporting reaction force fully upon the tubes to be bent, that is, on the inner tube as well as the outer tube, because practically in the region of the inserted mandrels, there is no hollow space present within the tubes, but rather the interior space is occupied by the mandrels; and the portion of the inside wall of the large tube which is becoming convex in bending serves instantaneously as a form or die for the inside tube.

It is preferred that the mandrels be secured changeably removably mounted respectively on parallel-extending rod supports, and to reduce substantially the friction between inner surface of the tubes and the mandrels inserted therein, also to provide clearance relative to the tubes, so that the cross-section of the support rods be smaller than that of the respectively supported mandrels and the mandrel-receiving spaces. To facilitate mandrel release from the engaged metal inner wall surfaces of the tubes after a completed bending, and also to enable a change of the position of the mandrels relative to a bending die, the two mandrels further preferably should be shiftable axially of the tubes; and therefore especially advantageously a common shiftable slide support on the machine frame is provided for the tube mandrels on the bending machine end remote from the bending table.

In order to clamp the tube ends firmly on the bending form die, the die is advantageously constructed in such fashion that, in addition to a clamping support seat surface for the outer tube, it has a distinct appropriately disposed clamping seat surface for the inner tube extending endwise from and brought into eccentric disposition in contact with the outside tube in a clamped tubular work assembly. Then further the die-opposable clamping jaw will have a clamping surface disposed appropriately for the inner tube, that is, being notably outwardly offset from the clamping surface for the outer tube. For this purpose the clamping seat area can be unitary on the die; or, as described in the application for my U.S. Pat. No. 4,038,853 of Aug. 2, 1977, the latter can be comprised of two components, for the present invention namely, a basic major die portion for a given size outer tube and a separate jaw or seat portion which is changeable for inside tubes of different sizes; while of course, the shiftable clamping jaw may be changeable by providing on the jaw carriage a plurality of jaw formations selectively shiftable in and out of operative disposition, e.g., in an arrangement and by mechanism such as that disclosed in the aforesaid application for patent.

Further, on the tube feed and advance carriage, the work clamping collet has respective clamping means for the outer tube and for the inner tube extending therefrom; in which case, advantageously, the clamping collet means is comprised of two components which are rotatably supported one relative to the other, advantageously to enable shaping of the tubular work by successive bends in diverse planes. One of the functions of tube clamping means provided in or at the die region, either by clamping seats formed on the die and cooperating jaw or by an independent clamping device, namely securing the tubes against relative axial displacement, may then be aided or assumed by the double collet structure.

Other objects and advantages will appear from the following description and the drawings, wherein:

FIG. 4 is a view similar to FIG. 2, but showing the relations after completion of a 90° bending operation;

FIG. 5 is a fragmentary horizontal sectional detail, showing a modification for clamping of the tube ends for a first bend near the leading end of the work assembly, and also a collet modification;

FIG. 6 is an end view of the clamp device shown in FIG. 5;

FIG. 7 is a fragmentary horizontal sectional view through a further lead end clamping device;

FIG. 8 is a center plane sectional view of a bent work assembly immediately after the bending operation;

FIG. 9 is a view, similar to that of FIG. 8 of the two bent tubes, having the bending or curve radius as FIG. 8 but now shifted into an approximately coincident disposition of their central axes.

OVERALL FORM OF THE BENDING MACHINE

Figure 1:
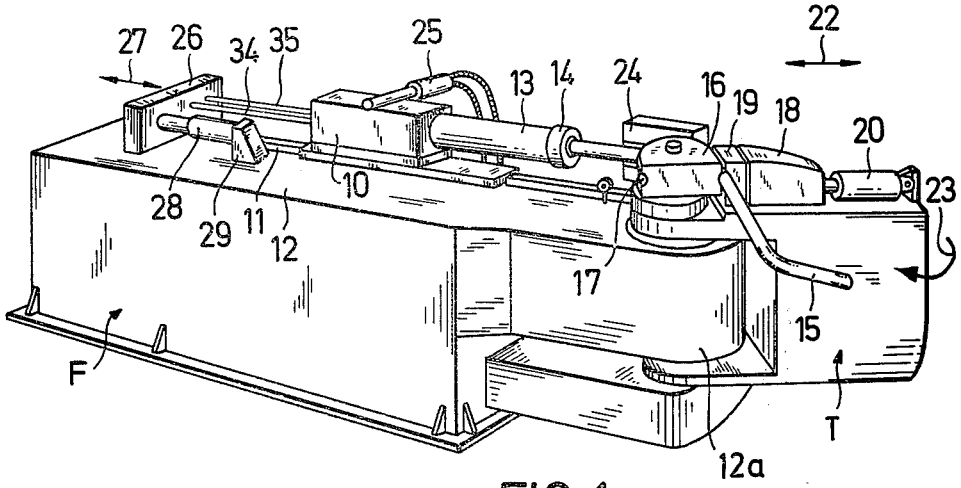
FIG. 1 is a perspective view of the bending machine as a whole, taken generally from one side and slightly toward one end of and slightly above the machine.

FIG. 1 shows the general structure and overall arrangement of the type of tube bending machine to which the present invention relates, but with no attempt to show details of certain expedients for clamping and forming the workpiece or tubes to be bent.

The machine is comprised of a base frame F and a bending swing table T horizontally swingably mounted, in a hinge-like or clevis-like structure, on a reduced, projecting right frame end 12*a* toward which a feed or advance carriage 10 for clamping tubular work is slideably mounted and guided on longitudinal rails or gibs 11 supported along one side of the horizontal bed top surface 12 of the frame.

The work advance carriage bears a tubular workpiece-accepting hollow cylinder 13 with axis horizontal and parallel to the rails 11, and including a rotatable tube-gripping means or collet 14 by known conventional means opened and closed for firmly gripping the outer tube 15*a* of a tubular work assembly 15 including also an inserted inner tube 15*b* as elsewhere described. The geometrical and coincident rotational axis of the collet and hence the axis of an initially straight tube therein gripped, extends horizontally and parallel to the rails 11.

This permits advance of the work while constrained to move along a straight line of the work axis as its forward portion is wrap bent about a die 16 in the forming tooling to be described; and also axially shifts the work in other manipulations.

A motor, e.g., hydraulic motor 25, in conventional manner, through a worm on the motor output shaft and a gear ultimately connected to the collet 14 is capable of driving the latter through at least 180°, and even 360° rotation, so that the tubular workpiece assembly can be not only clamped and moved longitudinally of the machine relative to the bed, but also the workpiece may be rotated by a desired amount about its axis at the collet-gripped tube portion, for successive bendings.

Known conventional power means (not here shown) are usually provided to drive the table T in a bending swing from, and to return it to, a start position perpendicular to the bed; and also to shift the feed carriage 10 longitudinally of bed 12 for feeding the work to a new bend location.

Typically, as specific bending tooling, the bend forming die 16 is mounted to turn in an assembly with the table coaxially of the vertical pivot axis of table swing at the projecting right frame end portion 12*a*, being in effect secured on and rotating with the table T in its swinging movements, so that an axially shiftable workpiece clamped to the die will be wrapped and bent into the die groove 17 to acquire a bend of corresponding radius of curvature and a bend arc determined by and substantially equal to the angle of swing, spring-back of the metal of course being considered.

The swing table T bears work-clamping means comprising on the die 16 a clamp seat portion as a jaw and a cooperating movable jaw mechanism including a tube-clamping jaw 19, longitudinally slideably supported through a jaw carriage 18 on the table T for advance to and retraction from the die 16, by a double-acting linear motor, such as a hydraulic or pneumatic cylinder 20, as indicated by the double-headed direction arrow 22.

A similarly horizontally straight-grooved bending reaction support slide block or shoe 24 is also mounted slidably on rails 11 with conventional (not shown) shift motor means on the bed 12 in the work lead-in region adjacent the bending form, i.e., between die 16 and collet 14, to offer reaction support to the tubular work against sidewise deflection away from the die during bending, this ensuring forcing the tube to wrap into the forming groove 17 of die 16, when the latter rotates upon the tube-bending table swing in the direction of arrow 23, with the tubular work clamped between die 16 and jaw 19. The straight groove is nearly semi-circular in cross-section with radius of curvature corresponding to that of the work exterior; that is, the groove on shoe 24 has a nearly semi-cylindrical surface with axis coincident with the axis of cylinder 13, collet 14 and of outer tube 15*a*.

The shoe 24 advances with the work either through friction engagement by the tube or forward motion imparted by its own to and fro drive means in either case followed by slippage with large bends.

Reference is made to the aforesaid patent application for exemplary details of the pivoted mounting of and part of the drive for table T, support for changeable die 16 and mechanism therefor to locate different parts of its periphery for selected use, part of mechanism for clamp jaw advance and retract, also provision of, and selective shift for, distinct jaw surfaces on a pivoted jaw.

At the end of the bending machine remote from the bending table T, (see FIG. 1), a support 26, preferably a slide likewise slideably supported on the guide rails 11, mounts the two mandrel-supporting or shank rods 34, 35, (which are later described in detail relative to the mandrels 30–31; see also FIGS. 2–4) to be displaceable by small amounts to and fro as indicated by the double-headed directional arrow 27, through a hydraulic or pneumatic mandrel shifting motor cylinder unit 28, which is anchored to a bracket 29 secured on the machine bed 12.

In actual bending of the tubular work, this support 26 is stationary.

FORMING BENDING DIE-CLAMPING MEANS

The forming die 16 (see also FIGS. 2 and 3), U-shaped in plan, has the arcuate peripheral groove 17 semi-circular in extent terminating in a short straight tangential portion as a clamping seat 17*a*. Generally the arcuate reach portion of the groove 17 is concentric with the axis of the rotation of the form die 16, hence the table swing axis. This groove is nearly semi-circular in cross-section which corresponds in curvature to the outside cylindrical shape of the larger outer tube 15*a* to be worked. The curved, that is torus, centerline of the groove lies in a horizontal plane perpendicular to the table swing axis, which plane for convenience of reference is termed the bending plane or the plane of the die 16. The common axis of cylinder 13, collet 14, and grooved shoe 24 lies in this plane, and hence also the axis of a straight tube major clamping surface 37 of the jaw 19 when in initial operative disposition cooperating with seat 17*a* on die 16, and so also the axis of the notably outwardly offset or eccentric clamping surface 36 on jaw 19 for the projecting end of small tube 16. The common axis of cylinder 13, collet-clamped tube 15*a* with its collet and groove of shoe 24, is colinear with the common axis of seat surfaces 17*a* and 37 when in initial clamping disposition (table T being perpendicular to bed 12) and thereafter during bending is substantially tangent to the curved or torus centerline of groove 17.

On the die also, for cooperating preferably with seat 36 in clamping the small tube, there is the clamp seat surface 38 outwardly offset from clamp seat 17*a* by about the outer tube wall thickness; when the jaw is in work clamping disposition relative to the die, the seat surfaces 38 and 17*a* being respectively like in radius to and coaxial with seat 36 and 37 on the jaw 19.

Thus the somewhat smaller radiused surface 38, smaller than the groove section radius of seat 17*a* or of groove 17 by the wall thickness of outer tube 15*a*, results in a slightly stepped overall seat formation on the die to receive the end of larger diameter outer tube 15*a* as well as the projecting end of inner tube 15*b* eccentrically disposed in the bending plane against the inside surface of large tube 15*a*.

The bending tooling, namely, forming die 16 keyed to support shaft 16*a* coaxial with the table pivot, clamping jaw 19 and shoe 24, or tube-contacting parts thereof such as clamp seat insert 16*b* (FIG. 4) are removably mounted by means permitting changeability to provide grooves and clamping seats of different diameters and a die bend forming groove curvature difference as required for accommodating work of different diameters, and to provide bends of differing radii. Since change in bend radius changes the radial spacing of the toroidal centerline for groove 17 from the axis of die support 16*a*, either the rails 11 carrying carriage 10, shoe 24 and mandrel support 26, or the mountings of these on the rails are shiftable in a direction at right angles to the tubular work feed axis.

Figure 2:
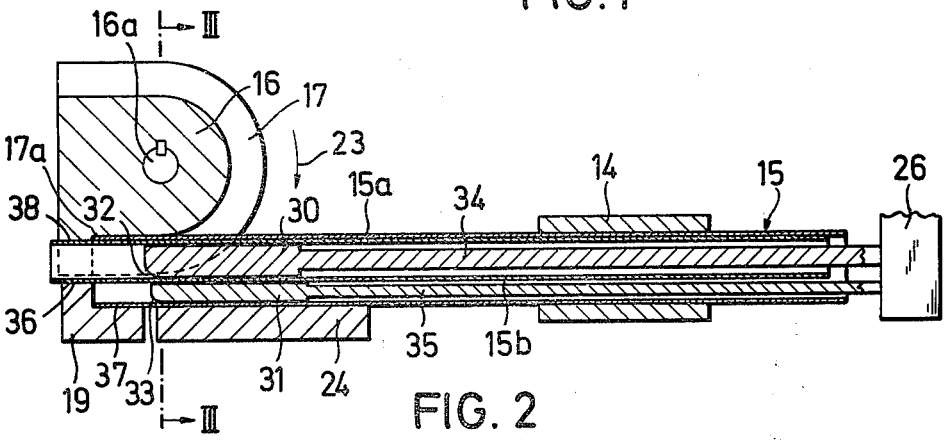
FIG. 2 is an enlarged top view of the machine, partially in section, showing the relation of the work and essential forming and support elements, at the start of a bending operation.
Figure 3:
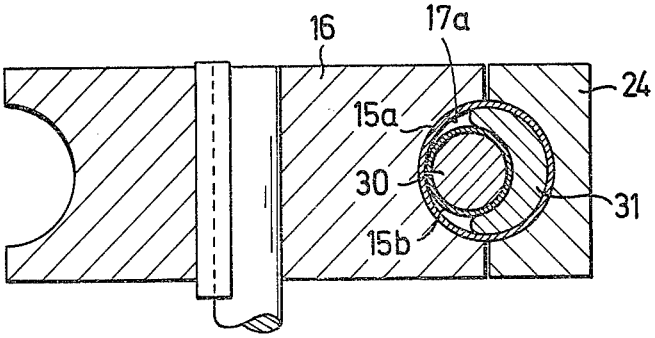
FIG. 3 is an enlarged vertical section taken at line III—III in FIG. 2.

This eccentric disposition is clear in enlarged FIGS. 2 and 3, with certain parts represented rather symbolically. FIG. 2 shows the relations prevailing at the start of a bending operation at the leading end of a tube workpiece assembly.

MANDRELS

A cylindrical mandrel 30 on rod 34 is provided for insertion into the inner tube 15*b*. Between the inner tube 15*b* and the outer tube 15*a*, at the side disposed remotely from the bending die and towards the support shoe 24, the second rod 35 supports the second mandrel 31 of crescent-shaped cross-section. On their sides disposed away from the bending die 16, the forward ends of mandrels 30 and 31 are provided with appropriate end roundings 32 and 33. The mandrel ends preferably are located for the bending operation as shown just to the left of (or in the direction of work infeed beyond) a plane through the table pivot and perpendicular to the feed axis or direction.

As is seen especially in the section of FIG. 3, the tube ends are clamped between die 16 and jaw 19, with the outer surface of inner tube 15*b*, on the side disposed towards the bending die 16, being held in longitudinal line contact along the inner wall of the outer tube 15*a*, at the horizontal center plane of the system, and with interior support of the tubes by the mandrels. Thus in the bending, the portion of the large tube inner wall becoming convex is instantaneously becoming in effect a form for the inner tube.

The mandrels, practically speaking, fill the hollow interior spaces of the tubes to provide reaction support and to keep the inner tube displaced and located eccentrically against the inner wall surface of the outer tube. The mandrel shiftability in axial sense enables quick and certain release of the mandrels from the tube walls after completion of a bend; and also adjustment of mandrel position for different bending situations.

Some flexibility is desirable in the rods 34–35; and each has a cross-section smaller than the respective mandrel, affording tube clearance to avoid an otherwise possibly arising rubbing friction. Though shown unitarily formed on the respective support shank rods 34 and 35, the mandrels 30–31 proper may be separate for preferably easy releasable securement and changeability, so that merely the mandrel portions proper need to be changed, upon change in the diameter of the work tubes.

FIGS. 5–6–7; END CLAMPING VARIATION

Whereas FIGS. 2–4 depict the eccentric securement of the tube 15*b* in tube 15*a* through a "step-formed" clamping jaw 19 cooperating with clamping seats on the die, on the other hand, FIGS. 5, 6, 7 show a modified approach whereby the outer tube and the inner tube lead ends are fastened to each other securely for bending, through a two-piece clamping device distinct from the die 16 and the jaw 19, namely the clamping block 39 in FIGS. 5–6 for eccentric clamping or block 39A in FIG. 7, for clamping the ends coaxially or with less eccentricity. This facilitates plural bends on one work assembly, as in FIG. 5 where completion of a second bend, of 45° is shown.

For this purpose the clamping jaw 19 has as at 37 a single seat for outer tube 15*a*, and on the die 16 there is only the seat 17*a* with no offset surface 38. Thus a tube 15*a* can project beyond both ends of the seats 17*a* and 37.

In the device of FIGS. 5–6, the first clamp part 39 and the second part 39*b* have opposed cooperating clamping seat surfaces 41*a* and 42*a* for the outer tube 15*a* and eccentric to 41*a*–42*a* the surfaces 41*b*–42*b* for the inner tube 15*b*. The two parts 39*a* and 39*b* can be secured by various means to one another for clamping of the tubes, thus for example through use of bolts 40 or lever closure devices or also hydraulic or pneumatic securing means served by appropriate flexible pressure lines. The device 39, with tube ends clamped as shown in FIG. 5, is usually positioned at the start of the work for the first bend close to the left edge of die 16 in its start position. Then after the first bend is completed, the work may be advanced for another bend; where the second bend is in the same plane and in same sense, the device 39 being at times left in place to retain its function of securing tubes to each other against relative axial displacement. The eccentric block 39 after a first bend in the end region may be loosened and rotated as may be useful aiding positioning of the inner tube in the outer for subsequent bending.

Since the die 16 and jaw 19 then need have seats only for the outer tube, after the first bend at the end, successive bends can be made on a single work assembly without other special provision for clamping the outer tube, unless a curve is to follow so closely upon a curve as to require curved clamp seats, providable in the die and jaw mechanism as in the above mentioned patent application.

FIG. 7 shows a similar device 39A with structure identical to that of block 39 excepting that the tubes ends are clamped coaxially or at least not with the extreme eccentricity of FIGS. 5–6. This clamp block may be particularly useful for example where the first bend is more remote from the leading end of the work; and where, with the inherent resiliency or elasticity of the work, the work with device 39A in place can be loaded from the die region with the mandrels holding the inner tube eccentrically against the inside of the outer tube, or conversely, the clamp device 39A may be applied after the work is loaded into the machine on the mandrels.

CLAMPING COLLET MODIFICATION—FIG. 5

In FIG. 5 also appears a modification by which the clamping collet 14 is constructed of two assemblies, to provide a first part 14*a* that grips the outer surface of the outer tube 15*a*, and a second part 14*b* which includes passages for the eccentric mandrel supports 34–35 therethrough and a rotatable eccentric clamping collet portion 14*c* to grip externally a projecting back end part of the inner tube 15*b*, and rotate it as may be needed. The collets as such are only symbolized by the designated parts, their respective structures as collets being as such conventional.

Thus by the clamping of both tubes at the collets relative axial shift of the tubes may be prevented as well as rotational drift. Hence for many bends the clamping of the tubes at the collets may eliminate need to use clamping means at the leading end of the work, e.g., eliminate need to use a clamping device such as block 39 or 39A.

To position the work for a succeeding bend in a different plane, the clamping collet 14 rotates the outer tube, while the clamping collet 14*b* so turns and/or holds the inner tube that at the bending region the inner tube is again applied in contact with the inside of the outer tube 15*a* at its side there disposed towards the bending die 16.

Additionally at the eccentric bore in the part 14*b* receiving the clamping collet 14*f*, a planetary drive can also find application to rotate the collet 14*f* even while clamped on tube 15*b*.

OPERATION

With the die in position of FIG. 2, after the straight tube 15*a* has been inserted over both mandrels 30–31 and through the clamping collet 14, tube 15*b* has been inserted through tube 15*a* and over mandrel 30, and the left tube ends have been brought into bending position, the outer tube and inner tube ends are clamped on the bending die (FIG. 2) by the clamping jaw 19, the advance carriage 10 is appropriately retracted and its collet closed to clamp 15*a*, and the shoe 24 positioned as in FIGS. 2–3, where the collet arrangement described for FIG. 5 is used, of course, the tubes are inserted to the positions as shown in FIG. 5.

The bending table is then turned in the arrow-indicated direction 23, by way of example about 90° into the position indicated in FIG. 4, to accomplish the actual bending. During the bending operation the two tubes remain securely clamped by the clamping jaw 19 against the seats on bending die 16, and the convexly curved die-ward inside wall portion of outside tube 15*a* in effect serves as a form for bending of the inside tube.

With this rotation, the tubular work is bent, either as suggested by FIG. 4, with a running advance of carriage 10 associated then with a change in position of shiftable reaction support shoe 24; or under some circumstances with the clamping collet 14 released to allow the work to draw through the carriage. In the first case the collet is usually released and the shoe 24 and carriage 10 retracted before collet reclamping to manipulate the work; in the second case the shoe is retracted and the collet reclamped before further machine manipulation of the work to new disposition for further operations.

After the bending operation, the clamping jaw 19 and the support member 24 are released (or retracted to original position). The mandrels 30, 31 together are drawn back slightly in the direction indicated by the arrow 27*a* through appropriate actuation of the hydraulic cylinder unit 28, thus with a certainty and in a simple manner to release the mandrels from any wedging or adherence to the walls of the tubes in the respective regions of bending.

After work removal or after an appropriate shift of the bent work (to afford die return motion clearance) has been effected by the advance carriage shift and through the collet rotation, the bending table and therewith the die 16 are swung back into the start position for the next bending operation, and new work is inserted. Or with appropriate clamping means being used, e.g., as in FIGS. 5–6, the tubes 15*a*–15*b* are brought into position for a subsequent bending, so that bending can be many times repeated on a work assembly, for which the apparatus permits also the bending in diverse planes.

After the desired bend or bends have been completed on given work, of course it may be that one or more non-bending operations are to be carried out, as the inner tube being shifted to the desired final spacing and orientation in the outer tube, or the tubes being secured one to another, or the tubes trimmed in length especially the inner tube.

FIG. 8 shows a tubular workpiece assembly, by the invention bent through about 90° and comprised of two tubes 15*b* and 15*a*, having a straight starting or initial part (at the left) and a long straight terminal part, with the bend radius of the inner curve of the outer tube practically corresponding to the bend radius of the inner curve of the inner tube, since the radial difference determined by the wall thickness of the outer tube is not appreciable.

FIG. 9 shows that, with a relative shift to central disposition of the inner tube in the outer tube at the completed bend, for a double tube assembly, there results a nearly parallel disposition of the tube walls in the bent region as well as in the straight end regions.

To the extent that the tubes are centered at their ends — this in FIG. 9 purposely is not represented — and accordingly, the inner tube lies in the center of the outer tube, that is, practically a centrallized disposition of the inner tube and the outer tube is obtained, with securement of the tubes at their ends in the centrallized disposition, the usual elasticity of the inner tube enables a certain equalization or accommodation of the spacing.

For purposes of simplified representations in FIGS. 8 and 9 there is represented merely two tubes inserted one in the other and bent with a single bend. It is to be understood, of course, that as aforementioned the invention also enables the bending of a tubular work assembly successively in plural planes, and with different curve extents and, by appropriate tooling, different curvature radii.

With the advance of the tubular work through the bending die for the next bending, the inner tube can be so far displaced radially within the outer tube that there is provided that contact necessary for bending of the inner tube on the inner surface of the outer tube at the side directed towards the bending die.

I claim:

1. In an apparatus for bending a tube assembly, comprising an outer tube and an inner tube inserted radially spaced from the outer tube in the latter, a combination comprising, elongated support means; an arcuate bending die operatively connected to one end of said support means tiltably about a tilting axis between a starting position and a bending position; collet means on said support means displacable in the longitudinal direction of the latter for clamping at least the outer tube and for guiding the tube assembly toward the bending die; clamping means cooperating with the bending die for clamping a portion of the tube assembly against a portion of the bending die in such a manner that the outer surface of the inner tube is only in linear contact with the inner surface of the outer tube at a side of the latter facing said bending die; a cylindrical mandrel of a cross-section substantially equal to the inner surface of the inner tube located in the latter; a sickel-shaped mandrel in the space between the inner surface of the outer tube and the outer surface of the inner tube on the side of the latter facing away from the bending die, said mandrels having leading ends located substantially in a plane normal to the elongation of said support means and including said tilting axis, said mandrels extending from said leading ends toward said support means.

2. A combination as defined in claim 1, and including slide shoe means laterally of said bending die and engaging the outer surface of the outer tube on the side of the latter facing away from the bending die for preventing during tilting of said bending die away from said starting position buckling of said tube assembly away from said bending die.

3. A combination as defined in claim 1, and including means respectively extending through said inner tube and said space for connecting said mandrels at the ends thereof opposite said leading ends to a common holding member mounted in the end region of said support means opposite of said one end.

4. A combination as defined in claim 3, wherein said connecting means comprise a pair of parallel rods having each a cross section smaller than that of the mandrel to which they are respectively connected.

5. A combination as defined in claim 4, wherein said holding member together with said rods and said mandrels are movable in the direction of elongation of the support means.

6. A combination as defined in claim 5, wherein said holding member is in the form of a slide, and including fluid-operated cylinder and piston means for moving said slide and said mandrels connected thereto in said direction.

7. A combination as defined in claim 1, and including means for securing the leading ends of said tubes against axial movement relative to each other.

8. A combination as defined in claim 7, wherein said securing means are constituted by said clamping means.

9. A combination as defined in claim 7, wherein said securing means are constituted by additional clamping means engaging leading end portions of said tubes extending beyond said bending die.

10. A combination as defined in claim 9, wherein said additional clamping means has a first pair of clamping faces engaging a leading portion of said inner tube projecting beyond a leading portion of said outer tube, and a second pair of clamping faces engaging the leading portion of the outer tube, in which said first pair of clamping faces are arranged eccentrically with respect to said second pair to assure said line contact between said tubes.

11. A combination as defined in claim 8, wherein said clamping means has a first clamping face engaging a leading portion of the inner tube projecting beyond the leading portion of the outer tube and a second clamping face engaging the leading portion of the outer tube for pressing said tube portions against corresponding clamping face portions of said bending die.

12. A combination as defined in claim 9, wherein said additional clamping means comprises two parts and means for pressing the two parts towards each other.

13. A combination as defined in claim 1, wherein said collet means has a first clamping face coordinated with a trailing end portion of said outer tube and a second clamping face coordinated with a trailing end portion of the inner tube projecting beyond the trailing end portion of the outer tube.

14. A combination as defined in claim 13, wherein said collet means comprises two parts which are turnable relative to each other, and wherein said first clamping face is provided on one of said parts and said second clamping face on the other of said two parts.

15. In a method for bending a tube assembly comprising an outer tube and an inner tube inserted radially spaced from said outer tube into the latter in a bending apparatus having a bending die tiltable about a tilting axis, a clamping collet movable toward and away from the bending die and a slide shoe laterally of the bending die, the steps of bringing the inner tube at least over the whole region to be bent in the bending die at the side of the inner tube facing the bending die into linear contact with the outer tube; tilting the bending die about said tilting axis from a starting position to a bending position so as to wrap the tube assembly at least about part of the bending die while advancing the clamping collet toward the bending die; preventing collapse of the tubes during bending by inserting into the inner tube a first mandrel substantially filling the interior of the latter and between the outer surface of the inner tube and the inner surface of the outer tube at the side of the inner tube facing away from the bending die a second mandrel so as to fill substantially the space between the two surfaces, with the leading ends of the mandrels located substantially in a plane normal to the tube assembly between the bending die and the clamping collet and including said tilting axis; and preventing buckling of the tube assembly away from the bending die during bending by a slide shoe contacting the outer tube on the side thereof facing away from the bending die.

16. A method as defined in claim 1, wherein the step of bringing the inner tube in linear contact with the outer tube at the side of the latter facing said bending die comprises the step of clamping the leading ends of said tubes in an offset position on a portion of the bending die.

* * * * *